US010954758B1

(12) United States Patent
Yan et al.

(10) Patent No.: US 10,954,758 B1
(45) Date of Patent: Mar. 23, 2021

(54) DEVICE AND WORKING METHOD FOR DRILLING HYDRATE MICRO-BOREHOLE AND PERFORMING FAST COMPLETION

(71) Applicant: CHINA UNIVERSITY OF PETROLEUM (EAST CHINA), Qingdao (CN)

(72) Inventors: Chuanliang Yan, Qingdao (CN); Xiaorong Li, Qingdao (CN); Xu Ren, Qingdao (CN); Yuanfang Cheng, Qingdao (CN); Zhongying Han, Qingdao (CN); Yang Li, Qingdao (CN); Jia Wei, Qingdao (CN); Benjian Song, Qingdao (CN); Wanqing Tian, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 16/646,471

(22) PCT Filed: Jul. 30, 2019

(86) PCT No.: PCT/CN2019/098328

§ 371 (c)(1),
(2) Date: Mar. 11, 2020

(87) PCT Pub. No.: WO2020/206878

PCT Pub. Date: Oct. 15, 2020

(30) Foreign Application Priority Data

Apr. 8, 2019 (CN) ..... 201910274015.X

(51) Int. Cl.
*E21B 7/18* (2006.01)
*E21B 41/00* (2006.01)
(Continued)

(52) U.S. Cl.
CPC ..... *E21B 41/0099* (2020.05); *E21B 7/18* (2013.01); *E21B 43/088* (2013.01); *E21B 43/305* (2013.01)

(58) Field of Classification Search
CPC .. E21B 41/0099; E21B 43/305; E21B 43/088; E21B 7/18
See application file for complete search history.

(56) References Cited

U.S. PATENT DOCUMENTS 4,640,353 A * 2/1987 Schuh ..... E21B 7/061 166/117.6
5,413,184 A * 5/1995 Landers ..... E21B 7/061 175/424

(Continued)

FOREIGN PATENT DOCUMENTS

CN 110029968 7/2019

OTHER PUBLICATIONS

International search report dated Jan. 15, 2020 from corresponding application No. PCT/CN2019/098328.

(Continued)

*Primary Examiner* — Yong-Suk (Philip) Ro
(74) *Attorney, Agent, or Firm* — Hauptman Ham, LLP

(57) ABSTRACT

Disclosed are a device and a method of drilling a hydrate micro-borehole and performing fast completion, which belongs to the technical field of a hydrate extraction device and a hydrate extraction method. The method includes a continuous operation machine, a power control mechanism, a high pressure water jet pump, a guider, a continuous pipe, a parent pipe and a child pipe, the parent pipe is connected with the continuous operation machine, and an end of the child pipe is connected with a water jet nozzle; the working method basically includes the following: firstly, a large main borehole is formed by drilling to a destination layer at one time with a large size drill bit; secondly, a horizontal (Continued)

micro-borehole is drilled in a natural gas hydrate reservoir by a high pressure water jet device formed by the child and parent pipes and then the child pipe is heated to enable its skin to fall off and leave a screen; finally, the child and parent pipes are disconnected to perform well completion. The present disclosure is applicable to different natural gas hydrate extraction manners. In this way, well drilling and completion is integrated, sand production is effectively inhibited, and the production of the hydrate reservoir is increased with a small effect on the hydrate reservoir. Thus, drilling is accelerated.

6 Claims, 3 Drawing Sheets

(51) Int. Cl.
*E21B 43/30* (2006.01)
*E21B 43/08* (2006.01)

(56) References Cited

U.S. PATENT DOCUMENTS

2001/0045302 A1* 11/2001 Mazorow ..... E21B 7/065
175/67
2009/0288833 A1* 11/2009 Graham ..... E21B 7/18
166/306
2013/0213716 A1* 8/2013 Perry ..... E21B 7/061
175/62
2018/0045029 A1* 2/2018 Goksel ..... E21B 7/04

OTHER PUBLICATIONS

Written Opinion dated Jan. 15, 2020 from corresponding application No. PCT/CN2019/098328.
First Search dated Nov. 16, 2019 from corresponding application No. CN 201910274015.X.
The Decision to grant a patent dated Dec. 30, 2019 from corresponding application No. CN 201910274015.X.

* cited by examiner

DEVICE AND WORKING METHOD FOR DRILLING HYDRATE MICRO-BOREHOLE AND PERFORMING FAST COMPLETION

RELATED APPLICATIONS

The present application is a National Phase of International Application Number PCT/CN2019/098328, filed Jul. 30, 2019, and claims the priority of China Application No. 201910274015.X, filed Apr. 8, 2019.

TECHNICAL FIELD

The present disclosure relates to the technical field of a hydrate extraction device and a hydrate extraction method and in particular to a device and a working method for drilling a hydrate micro-borehole and performing fast completion.

BACKGROUND

Natural gas hydrate which is also called combustible ice is a non-stoichiometric cage compound formed by natural gas and water molecule under the condition of low temperature and high pressure. In an ideal state, each standard cubic meter of the hydrate may contain gas molecules equivalent to 180 times its own dissolved water in volume. China is the largest energy consumer in the world, which takes 23% of the global energy consumption. Today, along with increasing depletion of petroleum resources, it is urgent to find a new energy with advantages such as large resources volume, high energy density and low pollution to replace the traditional energy. As a result, natural gas hydrate becomes hotspot of different countries due to its large reserve, cleanness and high efficiency and widely recognized as an important subsequent clean energy with good prospect. Realizing development and utilization of natural gas hydrate resources is greatly significant for pushing energy industry development, improving energy consumption structure, guaranteeing safe energy supply, promoting ecological civilization construction and maintaining sustained economic and social development.

At present, the extraction method of the hydrate includes a depressurization method, a thermal excitation method and a chemical reagent injection method. In a natural gas hydrate extraction device and method disclosed in the patent numbered CN106837258A, the device mainly includes an extracting ship, a compressor, a gas engine, a vortex pipe and a gas-liquid separator and the extraction method mainly includes drilling through a hydrate overburden layer and a reservoir to form two gas injection wells which form a communication well, performing well completion for a horizontal section by a screen pipe, transporting natural gas to the vortex pipe after pressurizing the natural gas with the compressor on the extraction ship, injecting hot fluid of a hot end pipe outlet of the vortex pipe to the gas injection well by a gas injection pipe and allowing a hot current to enter the hydrate in the hydrate reservoir through the screen pipe so that the hydrate is decomposed into natural gas by heat and extracted out of a production well. A patent numbered CN109252833A discloses a natural gas hydrate extraction method. In this method, a water injection well and an extraction well are placed in sea, a hydrate reservoir is heated by the water injection well, the water injection well and the extraction well is communicated at a water surface through a first water pipe so that water discharged by the extraction well enters the water injection well, the extraction well and the water injection well are communicated by the first water pipe so that hot water separated from the extraction well is re-injected into the water injection well, thereby allowing part of hot water to form heat circulation, that is, low temperature water initially injected into the water injection well is heated and injected into the hydrate reservoir, the hydrate reservoir is heated so that a mixture extracted by the extraction well is of high temperature, and water separated from the mixture is re-injected into the hydrate reservoir.

However, these extraction methods may damage a stable structure of the hydrate when the hydrate reservoir is opened, resulting in decomposition of the hydrate. Further, during an extraction process, problems such as collapse of the overlying rock layer and sand production arising from loose hydrate reservoir and poor particle cementing strength may occur. Furthermore, frequent drill bit trips will lead to time and labor-consuming completion, affecting work progress and production. These problems have to be faced frequently during the extraction process of the hydrate.

SUMMARY

To overcome the defects of the above prior art, the present disclosure provides a device and a working method for drilling a hydrate micro-borehole and performing fast completion. With the device and the method, the frequent drill bit trips at the time of drilling a horizontal micro-borehole are reduced. Further, after the micro-borehole is drilled with a high pressure water jet, a high pressure hose wall is burned to leave a sand-proof screen pipe to perform well completion, thereby ensuring integration of well drilling and completion. Thus, time and labor are saved, interference of reservoir is small and sand can be prevented and production is increased.

One object of the present disclosure is to provide a device for drilling a hydrate micro-borehole and performing fast completion, which adopts the following technical solution.

A device for drilling a hydrate micro-borehole and performing fast completion includes a continuous operation machine, a power control mechanism, a high pressure water jet pump, a guider and a parent pipe. The continuous operation machine, the power control mechanism and the high pressure water jet pump are all located on a marine drilling platform and sequentially connected, one end of the parent pipe is connected with the continuous operation machine, a cable is wrapped on an inner pipe wall of the parent pipe, the other end of the parent pipe is connected with a parent pipe joint which is provided with a plurality of power control contact points 1 on a radial section, the parent pipe joint is installed with an electromagnetic iron, the radial section of the parent pipe joint is provided with a groove 1 and a sealing rubber ring is provided at the groove 1.

Further, a child pipe connected with the parent pipe joint is included. One end of the child pipe is connected with the parent pipe joint through a child pipe joint, the other end of the child pipe is connected with a water jet nozzle, and the child pipe runs through the middle of the guider; the child pipe is provided with a screen skeleton wrapped by carbon fiber and epoxy resin, an electro-thermal mechanism is provided in a cavity of the child pipe joint, the electro-thermal mechanism is connected with the screen skeleton and the child pipe and the parent pipe are connected together through the parent pipe joint and the child pipe joint.

The cable is used to control the electro-magnetic iron and control the electro-thermal mechanism through the power control contact point 1.

According to a preferred example of the present disclosure, the screen skeleton is made up of fine steel wires, the body material of the parent pipe joint is copper and four power control contact points 1 are disposed at the radial section of the parent pipe joint.

According to another preferred example of the present disclosure, the body material of the child pipe joint is magnetic iron, a groove 2 is opened at a radial section, and four power control contact points 2 are disposed at the radial section and a side connecting with the child pipe forms an arc.

Further, a magnetic shield is wrapped at an outer side of a connecting position of the child pipe joint and the parent pipe joint, the magnetic shield on the child pipe joint is completely wrapped and the magnetic shield on the parent pipe joint is wrapped in a fan shape.

Further, a pump pressure supplied by the high pressure water jet pump is 35-70 MPa.

Another object of the present disclosure is to provide a working method of drilling a hydrate micro-borehole and performing fast completion, which includes the following steps.

At step a, a large main borehole is formed by drilling to a hydrate reservoir with a drill bit, a lateral micro-borehole is reserved, casing running operation is performed for the large main borehole and then cement is injected to perform hole reinforcement.

At step b, a sealing rubber ring is placed on a parent pipe joint, a power source of an electro-magnetic iron is switched on by the power control mechanism to perform connection attraction with the child pipe joint, and magnetic shields are wrapped at the outer sides of the joints. At this time, the connection of the child pipe and the parent pipe is completed.

At step c, the child pipe and the parent pipe that are well connected are run into the borehole with the continuous operation machine.

At step d, the child pipe is guided to the hydrate reservoir through a guider, a high pressure water jet pump is started to spray a high pressure water jet to drill a horizontal micro-borehole and the drilling is performed to a destination displacement so that the child pipe joint is attracted to a casing of the reserved horizontal micro-borehole.

At step e, an electro-thermal mechanism in the child pipe joint is started with the power control mechanism to heat a screen skeleton of the child pipe, and epoxy resin in the child pipe is heated and ignited by introducing air until the epoxy resin is burned out. Thus, carbon fiber is attached to the screen skeleton.

At step f, the parent pipe joint is powered off to separate from the child pipe joint so that one horizontal micro-borehole is completed.

At step g, steps b-f are repeated to complete other horizontal micro-boreholes.

Compared with the prior art, the present disclosure brings the following beneficial technical effects.

(1) Compared with other natural gas hydrate extraction manners, the present disclosure adopts a manner of separation of the child pipe joint and the parent pipe joint, which is described as follows: a plurality of child pipe joints are placed into a wellbore through one parent pipe joint, and the child pipe and the parent pipe are directly separated after well completion so that the frequent drill bit trips at the time of drilling a horizontal micro-borehole are reduced; the hydrate reservoir is mainly composed of silty fine sand sediment, and the drilling is performed with high pressure water jet. Compared with the mechanical structure of the drill bit, the nozzle is simple and does not require replacement of drill bit, thereby avoiding the problem of drill bit sticking of the natural gas hydrate horizontal well. As a result, the working procedure is simple, and operation is conveniently performed with less time and labor.

(2) In the present disclosure, the large main borehole is firstly drilled and the horizontal micro-borehole is then drilled. With the structure of the large main borehole in cooperation with the multilateral horizontal micro-borehole, the well screen structure is optimized, the extraction contact area is increased, and the production of the hydrate is improved and the drilling of the horizontal micro-borehole in combination with water jet reduces the interference and damage to the hydrate reservoir.

(3) In the present disclosure, after the horizontal micro-borehole is drilled, the screen skeleton is directly heated to perform well completion without running a casing. Thus, the well drilling and completion is integrated so that the period of well drilling and completion is reduced and the labor and materials are saved. After the epoxy resin is burned, the carbon fiber is attached to a screen surface to reinforce the sand prevention effect of the screen. Thus, the production can be guaranteed while effective sand prevention is achieved.

BRIEF DESCRIPTION OF THE DRAWINGS

The present disclosure will be further described below in combination with the accompanying drawings.

Numerals of drawings are described as follows: 1—seawater, 2—reservoir overburden rock layer 3—hydrate reservoir, 4—reservoir under-burden rock layer, 5—marine drilling platform, 6—continuous pipe, 6-1—cable, 7—continuous operation machine, 8—power control mechanism, 9—high pressure water jet pump, 10—parent pipe joint, 10-1—power control contact point 1, 10-2—sealing rubber ring, 11—child pipe joint, 11-1—power control contact point 2, 11-2—groove 2, 11-3—electro-thermal mechanism, 12—guider, 13—high pressure hose, 13-1—epoxy resin and carbon fiber, 13-2—screen skeleton, 14—water jet nozzle, 15—magnetic shield, 16—large main borehole, and 17—cement.

DETAILED DESCRIPTION OF THE EMBODIMENTS

The present disclosure provides a device and a working method of drilling a hydrate micro-borehole and performing fast completion. In order to describe the advantages and technical solutions of the present disclosure more clearly, the present disclosure will be detailed below in combination with the specific examples.

The micro-borehole according to the present disclosure refers to a horizontal well with a borehole diameter less than 88.9 mm and a borehole curvature radius being about 0.3m.

With the device of the present disclosure, the well completion can be fast performed. "Fast" herein refers to that child and parent pipes are used to achieve integration of well drilling and completion and save drill bit trips and well completion time in the drilling process of the horizontal micro-borehole compared with a traditional drilling manner.

Figure 1:
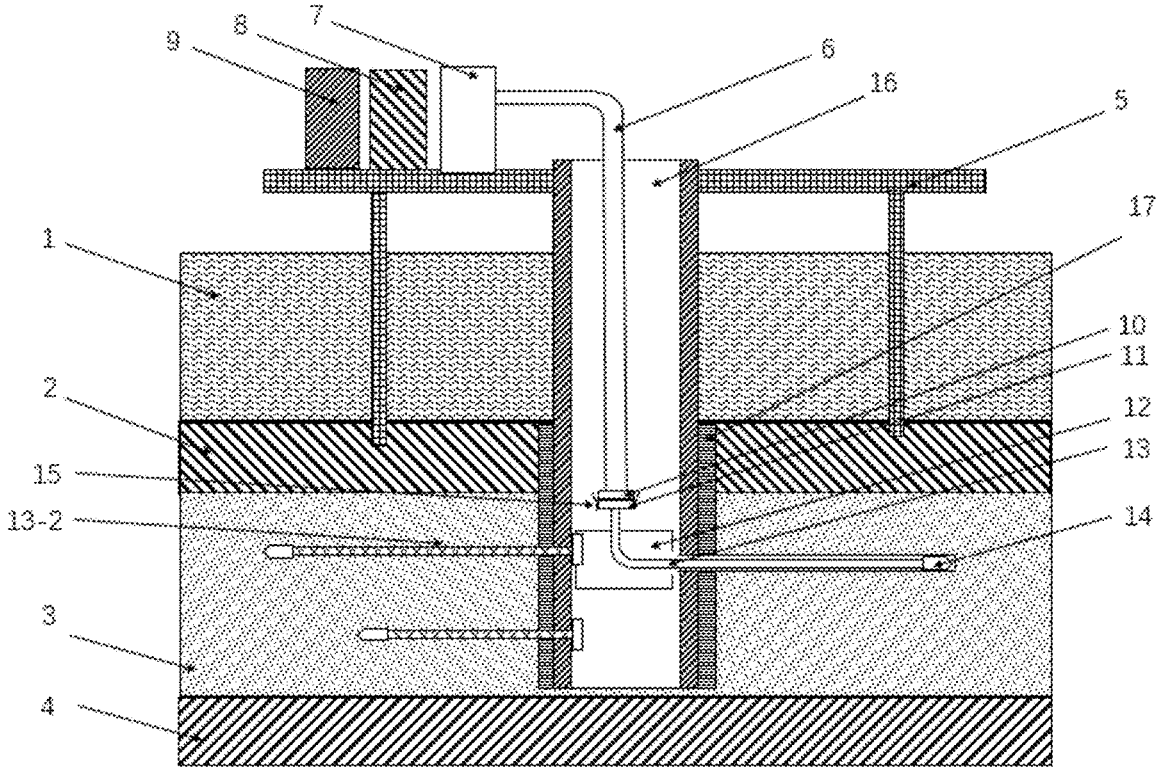
FIG. 1 is a schematic diagram illustrating an entire structure of a device for drilling a hydrate micro-borehole and performing fast completion according to an example of the present disclosure.
Figure 2:
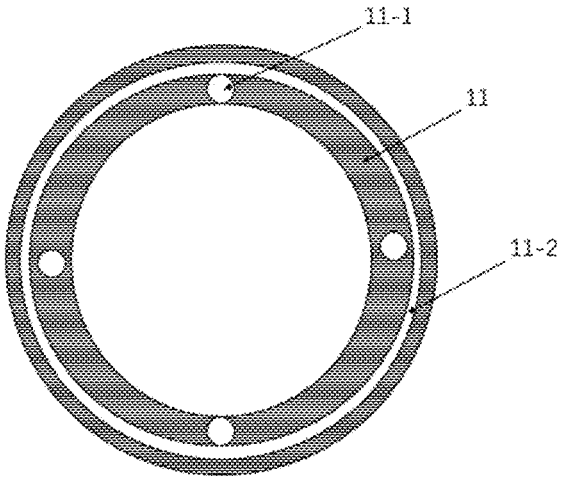
FIG. 2 is a schematic diagram illustrating a radial section of a child pipe joint according to an example of the present disclosure.
Figure 3:
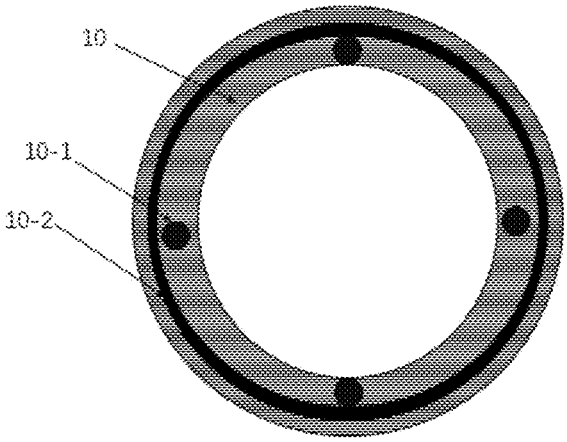
FIG. 3 is a schematic diagram illustrating a radial section of a parent pipe joint according to an example of the present disclosure.
Figure 4:
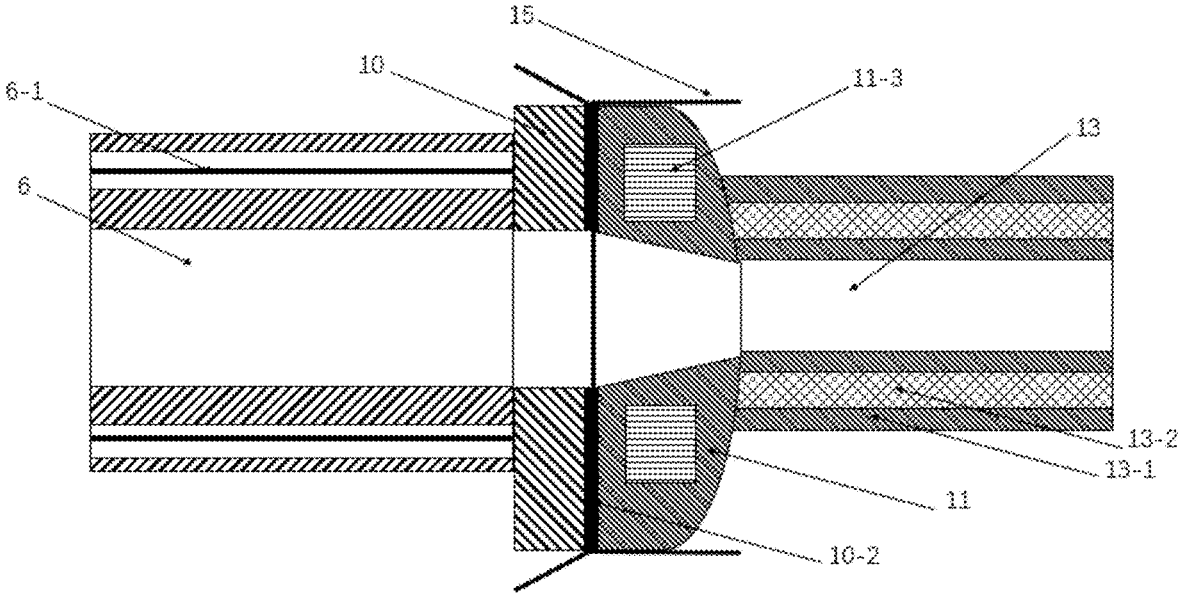
FIG. 4 is a schematic diagram illustrating axial sections of child and parent pipe joints and child and parent pipes according to an example of the present disclosure.
Figure 5:
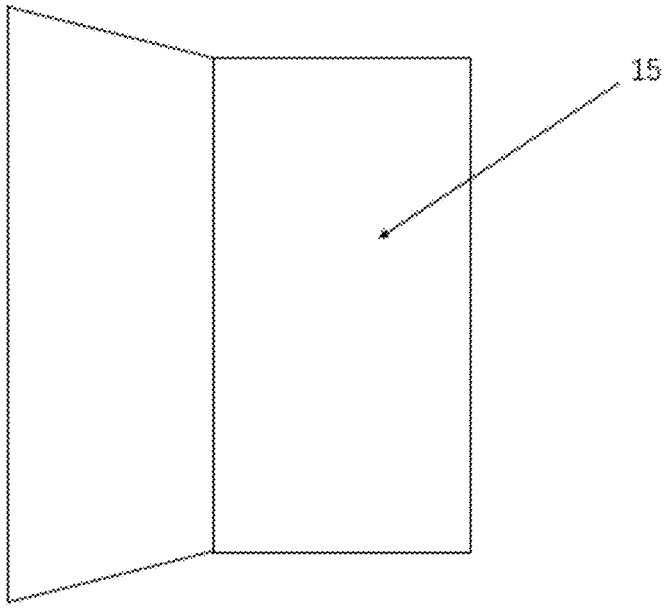
FIG. 5 is a schematic diagram illustrating a magnetic shield at outer sides of a child pipe joint and a parent pipe joint according to an example of the present disclosure.

FIG. 1 shows a device for drilling a hydrate micro-borehole and performing fast completion according to an example of the present disclosure. The device mainly includes a continuous operation machine 7, a power control mechanism 8, a high pressure water jet pump 9, a guider 12, and a continuous pipe (parent pipe) 6. The continuous operation machine 7, the power control mechanism 8 and the high pressure water jet pump 9 are all located on a marine drilling platform 5 and sequentially connected. As one of major improvements of the present disclosure, a parent pipe and a child pipe are removably connected with a specific structure shown in FIGS. 2-5. One end of the parent pipe is connected with the continuous operation machine 7 which may run the parent pipe into the borehole, the other end of the parent pipe is connected with a parent pipe joint 10 which is provided with a plurality of power control contact points 1 10-1 on a radial section, four power control contact points 1 are preferably provided according to an example of the present disclosure, the parent pipe joint is provided with an electromagnetic iron to facilitate connection with the child pipe joint, the body material of the parent pipe joint is copper, the radial section of the parent pipe joint is provided with a groove 1 which is provided with a sealing rubber ring 10-2, the parent pipe joint 10 has the body material of copper and is provided with the electromagnetic iron and the radial section is opened with a groove for placing the sealing rubber ring 10-2, the radial section is provided with four power control contact points 10-1, a cable 6-1 is wrapped on an inner pipe wall of the parent pipe to control the electro-magnetic iron of the parent pipe joint 10 and control an electro-thermal mechanism 11-3 of the child pipe joint through the contact points; one end of the child pipe is connected with the child pipe joint 11 and the other end is connected with a water jet nozzle 14 and the child pipe runs through the middle of the guider; a screen skeleton 13-2 is provided in the child pipe, the screen skeleton is made up of fine steel wires and wrapped by carbon fiber and epoxy resin 13-1, the electro-thermal mechanism 11-3 is provided in a cavity of the child pipe joint, the electro-thermal mechanism is connected with the screen skeleton 13-2, the diameter of the high pressure hose (the child pipe) 13 is Φ50 mm, and the child pipe and the parent pipe are connected together through the parent pipe joint and the child pipe joint.

Preferably, a body material of the child pipe joint is magnetic iron and a radial section of the child pipe joint is opened with a groove 2 11-2, four power control contact points 2 11-1 are provided at the radial section and a side connecting with the child pipe forms an arc. In this way, close attraction to a casing wall of the large main borehole 16 is facilitated upon well completion.

Further, magnetic shields 15 are wrapped at outer sides of the connection positions of the child pipe joint and the parent pipe joint, the magnetic shield on the child pipe joint is completely wrapped and the magnetic shield on the parent pipe joint is wrapped in a fan shape to facilitate subsequent separation.

Further, the pump pressure supplied by the above high pressure water jet pump is 35-70 MPa.

A working method of drilling a hydrate micro-borehole and performing fast completion is provided. The method adopts the device for drilling a hydrate micro-borehole and performing fast completion according to the present disclosure and includes the following steps.

At step 1, a large main borehole 16 is formed by drilling to a hydrate reservoir 3 with a drill bit, a lateral micro-borehole is reserved, casing running operation is performed for the large main borehole 16 and then cement 17 is injected to perform hole reinforcement.

At step 2, a sealing rubber ring 10-2 is placed on a parent pipe joint 10, a power source of an electro-magnetic iron is switched on by the power control mechanism 8 on the platform to perform connection attraction with the child pipe joint 11, and magnetic shields 15 are wrapped at the outer sides of the joints.

At step 3, a child pipe and a parent pipe that are well connected are run into the borehole with the continuous operation machine 7.

At step 4, the high pressure hose is guided to a destination layer through a guider 12, a high pressure water jet pump 9 is started to spray a high pressure water jet to drill a horizontal micro-borehole and the drilling is performed to a destination displacement so that the child pipe joint 11 is attracted to a casing of the reserved horizontal micro-borehole.

At step 5, a electro-thermal mechanism 11-3 in the child pipe joint 11 is started with the power control mechanism 8 on the platform to heat a screen skeleton 13-2 of the child pipe, and epoxy resin of the high pressure hose 13 is ignited by introducing air until the epoxy resin is burned out. Thus, carbon fiber is attached to the screen skeleton.

At step 6, the parent pipe joint 10 is powered off to separate from the child pipe joint 11 so that one horizontal micro-borehole is completed.

At step 7, steps 2-6 are repeated to complete other horizontal micro-boreholes.

In the above first step, a reservoir overburden rock layer 2 and seawater 1 are sequentially above the hydrate reservoir 3 and a reservoir under-burden rock layer 4 is below the hydrate reservoir 3.

Compared with other natural gas hydrate extraction manners, the present disclosure adopts a manner of separation of the child pipe joint and the parent pipe joint, which reduces frequent drill bit trips at the time of drilling a horizontal micro-borehole; the hydrate reservoir 3 is mainly composed of silty fine sand sediment, and the drilling is performed with high pressure water jet. Compared with the mechanical structure of the drill bit, the water jet nozzle 14 is simple and does not require replacement of drill bit, thereby avoiding the problem of drill bit sticking of the natural gas hydrate horizontal well. As a result, the working procedure is simple, and operation is conveniently performed with less time and labor.

A part not mentioned in the present disclosure may be realized by virtue of the prior art.

It is noted that any equivalent substitutions or obvious modifications made by those skilled in the art under the teaching of the present disclosure shall fall within the scope of protection of the present disclosure.

What is claimed is:

1. A device for drilling a hydrate micro-borehole and performing fast completion, comprising a continuous operation machine, a power control mechanism, a high pressure water jet pump, a guider and a parent pipe, wherein the continuous operation machine, the power control mechanism, the high pressure water jet pump are all located on a marine drilling platform and sequentially connected;

one end of the parent pipe is connected with the continuous operation machine, a cable is wrapped on an inner pipe wall of the parent pipe, the other end of the parent pipe is connected with a parent pipe joint, a radial section of the parent pipe joint is provided with a plurality of power control contact points 1, the parent pipe joint is provided with an electro-magnetic iron, the radial section of the parent pipe joint is provided with a groove 1 provided with a sealing rubber ring;

a child pipe connected with the parent pipe joint is further comprised, one end of the child pipe is connected with the parent pipe joint through a child pipe joint, the other end is connected with a water jet nozzle, the child pipe runs through the middle of the guider; a screen skeleton is provided in the child pipe, the screen skeleton is wrapped by carbon fiber and epoxy resin, an electro-thermal mechanism is provided in a cavity of the child pipe joint, the electro-thermal mechanism is connected with the screen skeleton and the child pipe and the parent pipe are connected together through the parent pipe joint and the child pipe joint; and the cable is used to control the electromagnetic iron and control the electro-thermal mechanism through the power control contact points.

2. The device according to claim 1, wherein the screen skeleton is made up of fine steel wires, a body material of the parent pipe joint is copper and four power control contact points 1 are provided at a radial section of the parent pipe joint.

3. The device according to claim 2, wherein a body material of the child pipe joint is magnetic iron, and a radial section of the child pipe joint is opened with a groove 2, the radial section is provided with four power control contact points 2 and a side connecting with the child pipe forms an arc.

4. The device according to claim 3, wherein magnetic shields are wrapped at outer sides of the connection positions of the child pipe joint and the parent pipe joint, the magnetic shield on the child pipe joint is completely wrapped and the magnetic shield on the parent pipe joint is wrapped in a fan shape.

5. The device according to claim 4, wherein a pump pressure supplied by the high pressure water jet pump is 35-70 MPa.

6. A working method of drilling a hydrate micro-borehole and performing fast completion, wherein the working method adopts the device for drilling a hydrate micro-borehole and performing fast completion according to claim 1 and comprises the following steps:

at step a, forming a large main borehole by drilling to a hydrate reservoir with a drill bit, reserving a lateral micro-borehole, performing casing running operation for the large main borehole and then injecting cement to perform hole reinforcement;

at step b, placing a sealing rubber ring at a parent pipe joint, switching on a power source of an electro-magnetic iron through a power control mechanism to perform connection attraction with a child pipe joint, and wrapping magnetic shields at outer sides of joints so as to complete connection of the child pipe and the parent pipe;

at step c, running the connected child pipe and parent pipe into a borehole by a continuous operation machine;

at step d, guiding the child pipe to the hydrate reservoir through a guider, starting a high pressure water jet pump to spray a high pressure water jet to drill a horizontal micro-borehole to a destination displacement so that the child pipe is attracted to a casing of the reserved horizontal micro-borehole;

at step e, starting an electro-thermal mechanism in the child pipe joint by the power control mechanism to heat a screen skeleton of the child pipe, and heating and igniting epoxy resin in the child pipe by introducing air until the epoxy resin is burned out so that carbon fiber is attached to the screen skeleton;

at step f, powering off the parent pipe joint to separate from the child pipe joint so as to complete one horizontal micro-borehole; and at step g, repeating steps b-f to complete other horizontal micro-boreholes.

* * * * *